United States Patent [19]

Ritchey et al.

[11] Patent Number: 4,778,305

[45] Date of Patent: Oct. 18, 1988

[54] SLIP-FORM PAVER WITH LATERALLY MOVEABLE PAVING TOOL

[75] Inventors: Paul E. Ritchey, Madison, Ind.; Joseph L. Jarboe, deceased, late of Richfield, Wis., by Jeanne B. Jarboe, personal representative

[73] Assignee: Rexworks Inc., Milwaukee, Wis.

[21] Appl. No.: 32,060

[22] Filed: Mar. 27, 1987

[51] Int. Cl.[4] ..... E01C 19/50

[52] U.S. Cl. ..... 404/105; 404/101

[58] Field of Search ..... 404/105, 104, 101, 102, 404/84, 96, 91

[56] References Cited

U.S. PATENT DOCUMENTS

| | | | |
|---|---|---|---|
| 2,591,502 | 4/1952 | Bohannan et al. | 404/84 |
| 3,221,618 | 12/1965 | Hudis | 404/101 |
| 3,396,644 | 8/1968 | Banks | 404/105 |
| 3,709,116 | 1/1973 | Whitbread et al. | 404/105 X |
| 3,791,753 | 2/1974 | Rymsa | 404/84 |
| 4,073,592 | 2/1978 | Godberson et al. | 404/105 X |
| 4,197,032 | 4/1980 | Miller | 404/105 X |
| 4,323,321 | 4/1982 | Dale | 404/105 |
| 4,493,585 | 1/1985 | Axer | 404/96 X |
| 4,682,909 | 7/1987 | Mihara | 404/91 X |

*Primary Examiner*—Jerome W. Massie
*Assistant Examiner*—Matthew Smith
*Attorney, Agent, or Firm*—George A. Evans

[57] ABSTRACT

A slip-form paver is provided which is capable of paving a lane of concrete or other material in much the same manner that asphalt is spread as a top paving surface for a roadway. Spreading and levelling means are not restricted to the space between the traction members of the tractor portion of the machine, but are arranged behind such members so that the slab may be wider than, or offset, with respect to the distance between such traction members. The mounting of the final paving tool is capable of lateral movement independently of the steering of the tractor members so as to enable it to turn on a different radius. The elevation of this tool may also be controlled from a string line or the like so as to provide the desired pavement surface contour.

8 Claims, 3 Drawing Sheets

SLIP-FORM PAVER WITH LATERALLY MOVEABLE PAVING TOOL

BACKGROUND OF THE INVENTION

Slip-form pavers have been widely used to pave concrete roads and generally comprise a tractor unit supported on two or four track assemblies with propulsion means, steering means and elevation means. From this tractor and usually at or near its midpoint is suspended a set of cross members consisting of a concrete spreading auger, a strike-off, internal vibrator for consolidating the concrete, a tamper bar and a screed or paving pan (sometimes called an extrusion meter). These latter elements will sometimes be referred to as a paving tool. On each side of the tool and located inside the traction means are the side forms which create the side edges of the ultimate concrete slab formed on the roadway as the machine moves progressively forward.

With the paving tool located near the longitudinal pivot point of the propulsion means, no steering problems are encountered should the machine be turned in either direction to provide the desired curve in the pathway of the road.

Development in the formulation of concrete mixtures has now made it possible to produce a concrete which will allow traffic on the pavement within 12 to 24 hours after placement. Such development permits the use of concrete overlays on previous pavements instead of the usual asphalt coating. In areas of heavy traffic and multiple lanes, only one lane may be shut down for placement of an overlay. If the pavement slab may be laid down during the interval, the overlaid lane can be opened for traffic the following day.

If the propulsion means are to travel within the confines of the lane to be overlaid, the spreading and paving means must be disposed behind and extend to a width at least as great as the outside width of the traction means. This has been done with asphalt paving machines in which the ends of the screed are supported by arms extending rearwardly from the tractor. Even the disposition of a spreading auger forwardly of the screed and also extending behind the traction members on the paver does not create a serious steering problem because of the close coupling of the units and the proximity of the screed to the center of turning radius of the tractor.

The mounting of the paving tool of a slip-form paver for concrete or other material in a manner similar to that of an asphalt paver creates a serious problem due to the significant distance between the location of the paving tool elements and the longitudinal pivot point of the tractor. The rear units of the concrete paver will swing on a much larger radius than rearmost elements of the asphalt paver. The more the distance from the tracks to the rear elements of the slip-form paving pan, the greater the radius of the path followed by the latter and the greater the distortion of the path from the desired plan.

SUMMARY OF THE INVENTION

Instead of rigidly connecting the paving tools of the slip-form paver behind the traction members of the paver so as to prevent vertical and lateral movement of the paving tools, the present invention provides that the paving tool is free to move sideways relative to the tractor. Lateral movement of the paving tools is controlled independently of the means for steering the tractor. This enables the path followed by the paving tool to more accurately follow the path pursued by the tractor instead of swinging in a wider arc. Provision is also made for adjusting the elevation of the paving tools so as to provide a smooth top surface despite undulations in the surface of the road bed.

Controls for steering the tractor may be similar to that previously used with a string line serving as a reference for lateral control of the tractor. The same string line is used to separately control the lateral movement of the paving tools. Other references such as the edge of an existing slab may also be used for this purpose.

DESCRIPTION OF THE DRAWINGS

In the drawings showing a preferred embodiment of the invention.

DETAILED DESCRIPTION OF THE DRAWINGS

Figure 4:
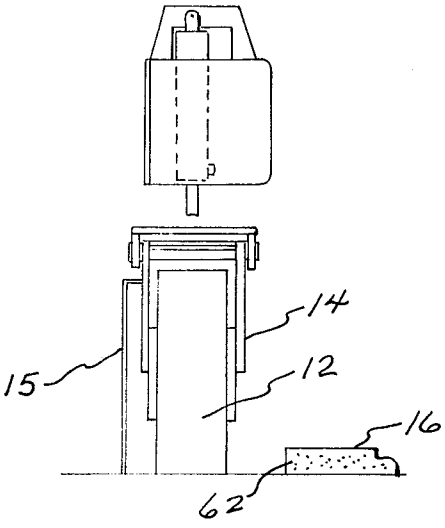
FIG. 4 is an end view taken from the front of the machine.

In the drawings, like numerals are employed to designate like parts in the various figures. The slip-form paving machine is identified generally by the number 11. It consists of the crawler tracks 12, one on each side of the tractor portion 13. Each track has a frame 14 on which it is mounted, and disposed inside the frame is a side form 15, the bottom of which is arranged to travel on a path very close to the surface being travelled by the track. The side form 15 is spring mounted on the frame to maintain its proximity to the road bed. No effort is made at this point to produce a definite contour to the sides of the slab, but the forms will prevent concrete from being spread too far laterally. As shown in FIG. 4, a previously laid adjoining slab 16 lies a short distance outside the outer edge of the crawler track 12. For overlay work, the thickness of the slab being laid may vary due to the specification of the mix design and the undulations of the road bed being overlaid, the purpose of overlays being to provide a new quality riding surface with a minimum of surface undulations.

The main frame 19 which extends over the tracks 12 and connects the two end frames 20, is supported on the track housing by means of the jacks 21. There are four jacks each of which is mounted over a section of the track, near the fore and aft ends thereof. Each jack 21 is operated by a cylinder 21' mounted on the frame 19, the cylinders being extended or retracted separately to maintain the frame in a level position over the traction means. By making the frame 19 in sections with a removeable section 19', its width can be varied by substituting sections of different width. The longitudinal dimension of the frame 19 is approximately the same as the length of the crawlers. Suspended from the main frame 19 by means of posts 22 is the auger 23 and the strike-off 24, which are designed to spread the material which has been deposited on the road bed. The auger is generally mounted on the strike-off to maintain its proper distance therefrom. These elements constitute the first set of spreading and levelling members.

The posts 22 which support the ends of the strike-off 24 are suspended from the frames 20 in any convenient manner and are designed to leave a level of concrete somewhat higher than that of the finished slab, the excess concrete being available to fill the space behind the tracks 12 to the desired final elevation of the widened slab.

A secondary set of spreading and levelling members, consisting of a strike-off 26 and auger 27 are mounted behind the crawler tracks, these elements being suspended from arms 25 extending from the end frames 19. Opposite the ends of these members are a second set of forms 28 spaced apart a distance equal to the specified width of the slab. As shown herein, the forms 28, which are truly slip forms are disposed outside the outside edges of the crawler tracks 12. The slip forms 28 instead of being suspended from the ends of the frame 20 are separately suspended from the paving pan 39, as will be subsequently described. The suspension of the strike-off 26 consists of the posts 29 which engage connecting members 30 extending through pivots 31 mounted on the upper surface of the strikeoff. The ends of these members 30 are engaged by the cylinder 32 to adjust the elevation of the strike-off independently of the elevation of the strike-off 24. The auger 27 is supported from the strike-off 28 and driven by a chain 33 in a conventional manner. The function of the secondary auger 27 and strike-off 28 is similar in some respects to that of the primary auger 23 and strike-off 24, except that they are used to distribute concrete over a path which is different from that as defined by the side forms 15. As shown herein, the ultimate width of the slab extends behind each of the traction members and the total width variably exceeds the total distance between the outer edges of the traction members.

Rearwardly of the strike-off 24 and approximately in line with the rear sprockets of the crawler tracks 12 are a spaced pair of pivots 36. Each pivot 36 is located slightly inside the adjoining track and extends upwardly a substantial distance above the top surface of the tracks. Extending rearwardly from the pivots 36 are the swing arms 37 and 38, the rearward ends of which are pivotally connected to the forward end of cross member (hereinafter called the paving pan) generally designated 39. The construction used to support the paving pan is similar on each side of the machine and will be described as to one side only. The pivoted mounting of the swing arms 37 and 38 enables swinging motion of the paving pan 39, the elevation of which however is fixed in regard to the frame 19.

Figure 1:
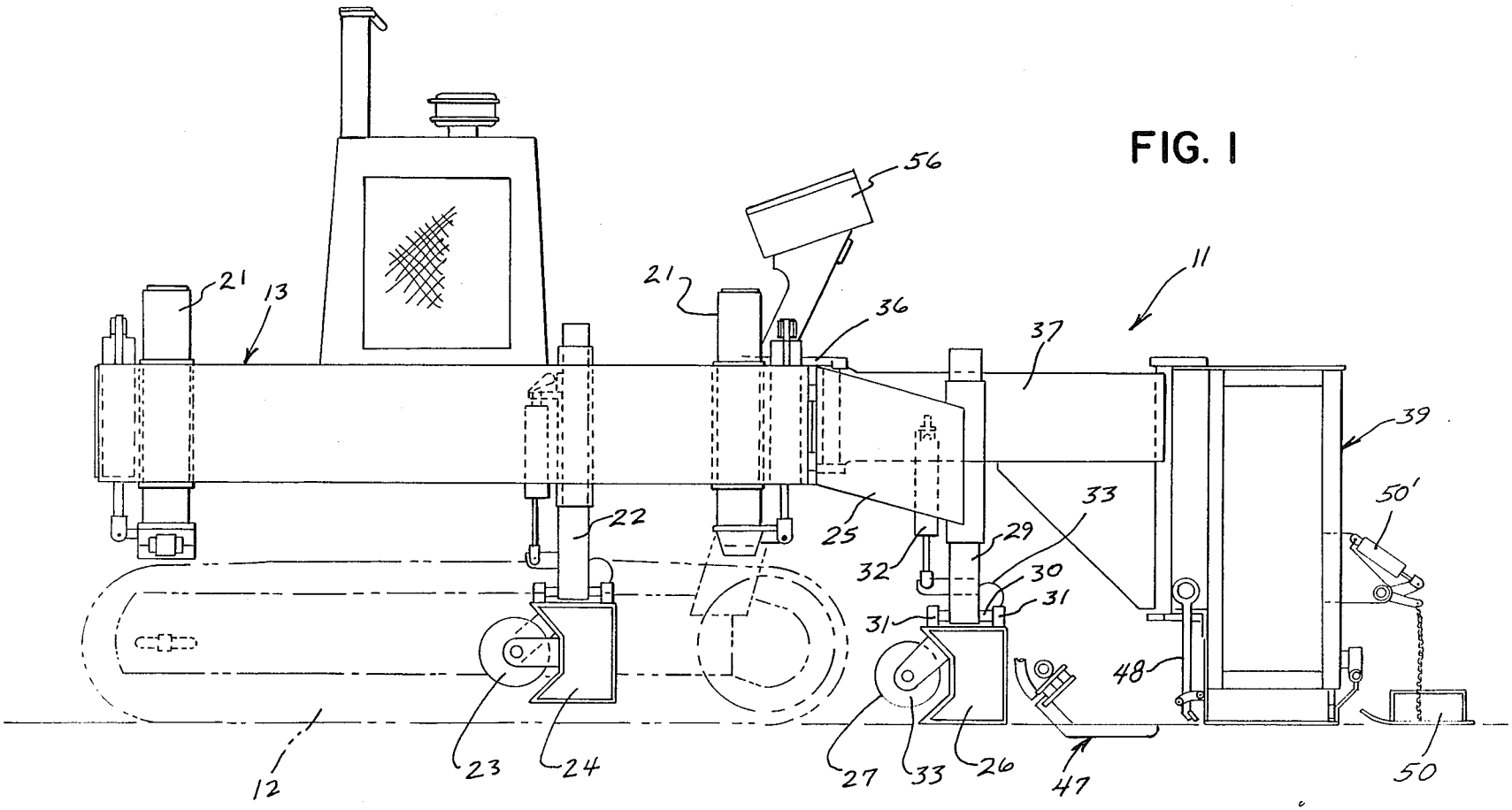
FIG. 1 is a side elevation of a slip-form paver with the paving tools located behind the tractor.
Figure 2:
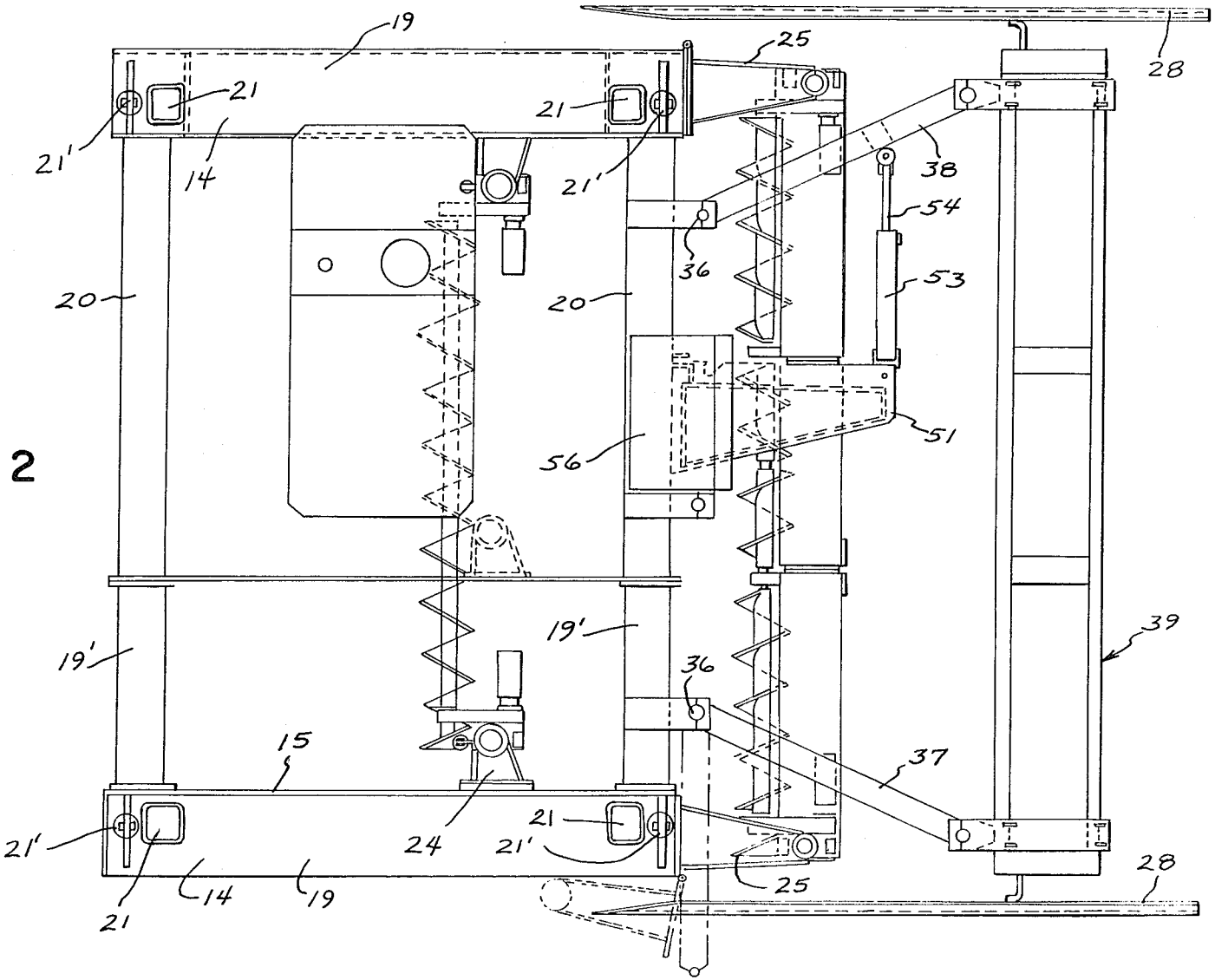
FIG. 2 is a plan view of the machine shown in FIG. 1.

It should be pointed out that the arms 37 and 38, as shown in FIG. 2, are not parallel but are rearwardly divergent so that the path of the concrete slab being laid will remain parallel to the reference (or to the adjoining slab, if there is an adjoining slab), as prescribed.

Supported on each end of the paving pan 39 are the slip forms 28 which extend to a position forward of the opposite ends of the auger 27. They are at right angles to the forward surface of the paving pan. The lower edges of the forms 28 are parallel to the surface to be paved and prevent lateral disposition of the concrete beyond the desired width.

To consolidate the material prior to its being finally extruded under the paving pan 39 and between the slip forms, vibration means 47 are disposed ahead of the pan 39. They are intended to vibrate this portion of the material. Their terminal portions are sufficiently close to the forward lower edge of the screeding surface of the paving pan 39 to effectively consolidate the material as it passes under the pan. Between such vibrator members and the paving pan is a tamper bar 48 mounted on the forward face of the pan. The tamper bar 48 is oscillated vertically to tamp concrete just before it passes under the pan. This insures the material leaves the paving pan as a smooth, closed surface. The mechanism for oscillating the tamping bar is conventional and need not be described herein.

To enhance the final finish to the slab, a float 50 may be dragged behind the paving pan 39 at a suitable distance. It should extend for almost the full width of the slab and have its forward edge curved upwardly so as not to disrupt the surface. The cylinder 50' is provided to adjust the elevation of the float.

The rearward end of the frame 19 is provided with a subframe arm 51 to which is connected the hydraulic cylinder 53, the operating piston 54 the outer end of which is connected to the side of one of the swing arms 38. It will be appreciated that extension or retraction of the piston 54 will cause lateral movement of the paving pan and the spaced slip forms mounted on each end of the paving pan.

Should it be necessary to move the paving tool manually as when being set prior to paving, an operator facing the panel 56 at the rear of the main frame may cause the piston 54 to be moved in the required manner.

Figure 3:
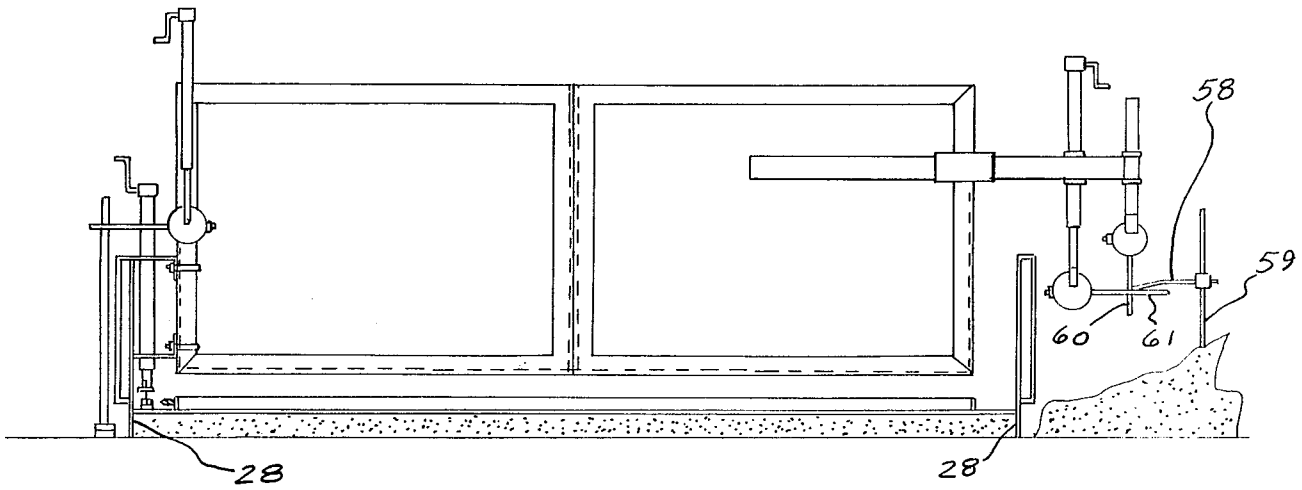
FIG. 3 is an end view of the machine shown in FIG. 1 take from the rear.

During normal operation of the machine, the position of the paving pan is under the control of a guideline 58 mounted on spaced stakes and brackets 59, as shown in FIG. 3. Vertical probes 60 are counter weighted to maintain contact between the probe and guidelines. Should the probe deviate from its vertical position it will actuate the valve to move the piston in the cylinder 53 to cause lateral movement of the paving tool including the pan 39. Similarly the elevation of the paving pan 39 can be controlled from the guideline 58 by the horizontal probe 61. The same guideline 58 is used to control the steering of the tractor portion 11, but each control is independent of the other. The tracks 12 generally follow the undulations in the road bed and to provide a smooth surface of the final slab, the elevation of the frame 19 as well as the elevation of the pan 39 is controlled by the elevation of the guideline 58.

If the pavement to be laid adjoins a previously laid section of concrete which has a well defined vertical edge, the side form 28 on the adjoining end of the pan is removed or raised and the paving pan is adjusted to abut the edge 62 of the adjoining slab. Accordingly the second slab may be laid adjacent the original slab without gaps or overflow of excess concrete. In this instance the probe 60 may be set to contact the edge 62 for steering control of the paving pan.

The crawlers 12 are individually driven and changing the speed of one with respect to the other causes the machine to turn on the desired radius to produce the necessary road curvature. By mounting the final paving elements, as herein provided, they can be separately steered and follow the same reference line as the tractor 13 follows. Actually, it is the course of the pavement disposed between the slip forms that is critical and their separate mounting and independant lateral movement enables them to follow the desired course.

For transporting the machine between different paving jobs, the arms 38 and 39 and the arms 25 may be swung into the dotted line position shown in FIG. 2. The second set of spreading and levelling members as well as the paving tool including the pan 39 are previously removed. The overall width of the remaining elements may then allow them to be transported on a highway under a special permit.

It will be appreciated that the construction herein shown and described allows the tractor portion of the paver to turn in a desired manner as controlled from a reference, such as a string line or the adjoining section of a previously laid pavement. The side motion of the paving tool 39 is controlled from the same reference, but independently of the turning motion of the tractor. The divergent supporting arms of the paving pan will cause the paving pan to become non-parallel to the rear frame of the tractor but nearly parallel to the tangent of the arc established by the curving string line. Accordingly, both the tractor and the paving pan will follow the radius as established by the string line.

Adjustment of the elevation of the paving tool, as previously described, may also be under the control of the string line 58. In other cases, it may be controlled by a ski that follows the surface of a previously laid adjoining slab of concrete.

The invention having been described what is claimed is:

We claim:

1. A slip-form paver comprising a main frame supported by spaced traction members between which a supply of concrete paving material is deposited on a road bed to form an initial single layer of paving material, means disposed between the traction members for spreading and levelling said single layer of material, a paving unit including separate levelling and smoothing means arranged rearwardly of the traction means and crossivise of the road bed, said separate levelling and smoothing means being arranged to increase said single layer width and depress the surface of the paving material to decrease said single layer thickness, and means connecting the paving unit and the main frame whereby the traction members tow the paving unit, said connecting means enabling lateral movements of the smoothing means portion of the paving unit with respect to the main frame and means for so moving the paving unit.

2. Apparatus as set forth in claim 1 wherein the paving unit and the spreading and levelling means desposed between the traction members each includes slip forms at the extremities thereof, the slip forms at the extremites of the paving unit, being spaced apart to prevent lateral disposition of the paving material beyond the desired width of the road bed.

3. Apparatus as set forth in claim 1 including a first set of spreading and levelling means disposed between the traction members, a second set of spreading and levelling means supported by the main frame rearwardly of the traction members and forwardly of the paving unit with the two sets of spreading and levelling means generally parallel to each other, the means for connecting the paving unit to the main frame comprising rearwardly diverging arms pivotally connected to the paving unit enabling the paving unit to remain perpendicular to the paving edge.

4. Apparatus as set forth in claim 3, including slip forms mounted on the ends of the paving unit, the forward ends of said slip forms extending opposite the ends of said second set of spreading and levelling means.

5. A slip-form concrete paver comprising a main frame supported by spaced traction members, side forms adjacent the inner edges of the traction members, a first set of spreading and levelling means disposed between said side forms, a second set of laterally non-movable spreading and levelling means located behind the traction members arranged to increase the width and lower the surface of the paving material, means for adjustably supporting the height of said first and second sets of spreading and levelling means, a paving tool arranged rearwardly of said second set of spreading and levelling means, means for adjusting the elevation of said paving tool independently of the elevation of said two sets of spreading and levelling means, and means for laterally moving said paving tool independently of movement of the first and second sets of levelling and spreading means.

6. Apparatus as set forth in claim 5 including means disposed between the second set of spreading levelling means and the paving tool arranged to vibrate the concrete confined by the side forms and prior to its passage under the paving tool.

7. In a concrete road paving machine, a tractor having spaced propulsion means, means for steering the tractor, a first set of side forms arranged inside of the propulsion means, spreading means supported in a crosswise manner from the tractor and between the side forms, a tool package mounted in a cantilevered manner behind the tractor, siad tool package including a paving pan extending crosswise behind the propulsion means, a set of parallel slip forms mounted on the ends of the paving pan confining the side edges of material being smoothed and consolidated by the pan, the forward ends of said slip-forms over-lapping the rearward ends of the propulsion means and disposed outside the path thereof, and means for separately steering the tool package separate from the tractor steering means to enable it to move laterally and remain perpendicular to the paving edge so that said slip forms are tangent to an arc being followed when a road bed becomes curved.

8. Apparatus as set forth in claim 7 including means for elevating the tool package independently of the elevation of the spreading means.

* * * * *